US006971196B2

(12) United States Patent
Fernandez et al.

(10) Patent No.: US 6,971,196 B2
(45) Date of Patent: Dec. 6, 2005

(54) MESSAGE SIGN

(75) Inventors: Mark Fernandez, Coto De Caza, CA (US); Carl L. Erwin, Brea, CA (US)

(73) Assignee: National Signal, Inc., La Mirada, CA (US)

( * ) Notice: Subject to any disclaimer, the term of this patent is extended or adjusted under 35 U.S.C. 154(b) by 132 days.

(21) Appl. No.: 10/201,661

(22) Filed: Jul. 24, 2002

(65) Prior Publication Data

US 2004/0016156 A1 Jan. 29, 2004

(51) Int. Cl.[7] ..... G09F 13/28; G09F 3/04
(52) U.S. Cl. ..... 40/550; 40/452
(58) Field of Search ..... 40/452, 550, 551, 40/559, 606.18, 616, 552, 572; 362/812; 340/815.53; 345/59

(56) References Cited

U.S. PATENT DOCUMENTS

| | | | | | |
|---|---|---|---|---|---|
| 671,618 | A | | 4/1901 | Brewster | |
| 842,954 | A | * | 2/1907 | Howe | 40/551 |
| 982,352 | A | * | 1/1911 | Diehl | 40/550 |
| 1,203,582 | A | * | 11/1916 | Chase | 40/551 |
| 1,723,471 | A | | 8/1929 | Dunham | |
| 2,086,860 | A | * | 7/1937 | Erickson | 40/611.06 |
| 2,823,473 | A | * | 2/1958 | Jacobs | 40/605 |
| 3,067,536 | A | * | 12/1962 | Brittsan | 40/615 |
| 3,409,765 | A | | 11/1968 | Trame | |
| D284,486 | S | * | 7/1986 | Gransden | D20/42 |
| 4,879,549 | A | | 11/1989 | Eby | |
| 5,003,233 | A | | 3/1991 | Proud et al. | |
| 5,031,083 | A | | 7/1991 | Claesson | |
| 5,660,461 | A | | 8/1997 | Ignatius et al. | |
| 5,768,814 | A | * | 6/1998 | Kozek et al. | 70/570 |

OTHER PUBLICATIONS

National Signal brochure and specifications, "Sunup Solar Arrow Panel," date unknown.
National Signal brochure and specifications, "Directional Display Panels™," date unknown.

* cited by examiner

*Primary Examiner*—Brian K. Green
(74) *Attorney, Agent, or Firm*—Brinks Hofer Gilson & Lione

(57) ABSTRACT

A message sign includes a panel having a plurality of ribs each defining an interior channel. The plurality of ribs are preferably spaced apart in parallel relationship. At least one lamp is secured through an opening in at least one of the ribs. In one preferred embodiment, the message sign includes a first and second panel, each preferably including a base web, wherein the ribs of the first and second panels extend outwardly from the base web of the respective panels. The base webs of the first and second panels are abutted with the ribs thereof extending outwardly therefrom in opposite directions. The first and second panels are oriented such that at least some of the channels of the first panel cross at least some of the channels of the second panel and form a plurality of junctures of crossing channels. Preferably, at least one lamp is secured through an opening in at least one of the plurality of ribs at one of the junctures. A method of manufacturing a message sign is also provided.

20 Claims, 5 Drawing Sheets

MESSAGE SIGN

BACKGROUND

The present invention relates to a message sign, and in particular, to a message sign having one or more structural panels and to a method for the manufacture thereof.

Message signs are typically deployed to advise drivers of upcoming obstacles and lane closures, and to provide instructions about the flow of traffic. Such devices can include directional or instructional displays, electronic flashing arrows, flashing arrow panels and arrow boards. Often, such signs include a frame supporting spaced apart front and rear skins, with a plurality of lamps secured through one or both of the front and rear skins. The lamps are selectively lit to provide instructional indicia, such as directional information. Typically, such structures, including the frame and skins, are made of metal, such as aluminum. These types, of message signs, which incorporate an internal frame and are made of metal, can be relatively expensive to manufacture.

SUMMARY

Briefly stated, in one preferred embodiment described below, a message sign includes a panel having a plurality of ribs each defining an interior channel. In one preferred embodiment, the plurality of ribs are spaced apart in parallel relationship. At least one lamp is secured through an opening in at least one of the ribs and has a portion accessible from the interior channel defined by that rib.

In one preferred embodiment, the message sign includes a first and second panel, each preferably including a base web and ribs that extend outwardly from the base web of the respective panels. The base webs of the first and second panels are abutted with the ribs thereof extending outwardly therefrom in opposite directions.

In one preferred embodiment, at least some of the interior channels of the first panel cross at least some of the interior channels of the second panel and form a plurality of junctures of crossing channels. Preferably, at least one lamp is secured through an opening in at least one of the plurality of ribs at one of the junctures.

In a preferred embodiment, a plurality of lamps are secured through a plurality of openings at a plurality of the junctures formed by the crossing channels. Also in a preferred embodiment, at least one lamp is secured through an opening formed in the second panel at one of the junctures.

In another aspect, a method of manufacturing a message sign preferably includes providing a pair of panels each having a base web and a plurality of ribs extending outwardly therefrom and positioning the panels in a back-to-back relationship with the ribs of the panels extending away from each other respectively. The method further includes orienting the panels such that the channels of the panels cross each other and thereby form a lattice with a plurality of junctures of crossing channels and thereafter connecting the panels. The method also includes forming a plurality of openings in at least one of the panels, wherein the openings are aligned with at least some of the junctures once the panels are oriented relative to each other, and securing a plurality of lamps through the openings.

The preferred embodiments of the message sign, and the methods of manufacturing the message sign, provide significant advantages over other message signs and methods of manufacture. For example, the panels can be easily and inexpensively molded from a plastic material. As such, the sign is relatively flexible and resilient, which can help to minimize the damage to an impacting vehicle in the event of an accidental collision with the sign. Moreover, the ribs of the panels provide structural rigidity without the need for an internal frame structure, which can reduce the overall cost of the sign. In addition, each of the front and rear panels are preferably made from an identical skin, with the position and number of holes formed therethrough being the only difference therebetween. Accordingly, the panels can be made from one mold, and the inventory of parts can be reduced.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
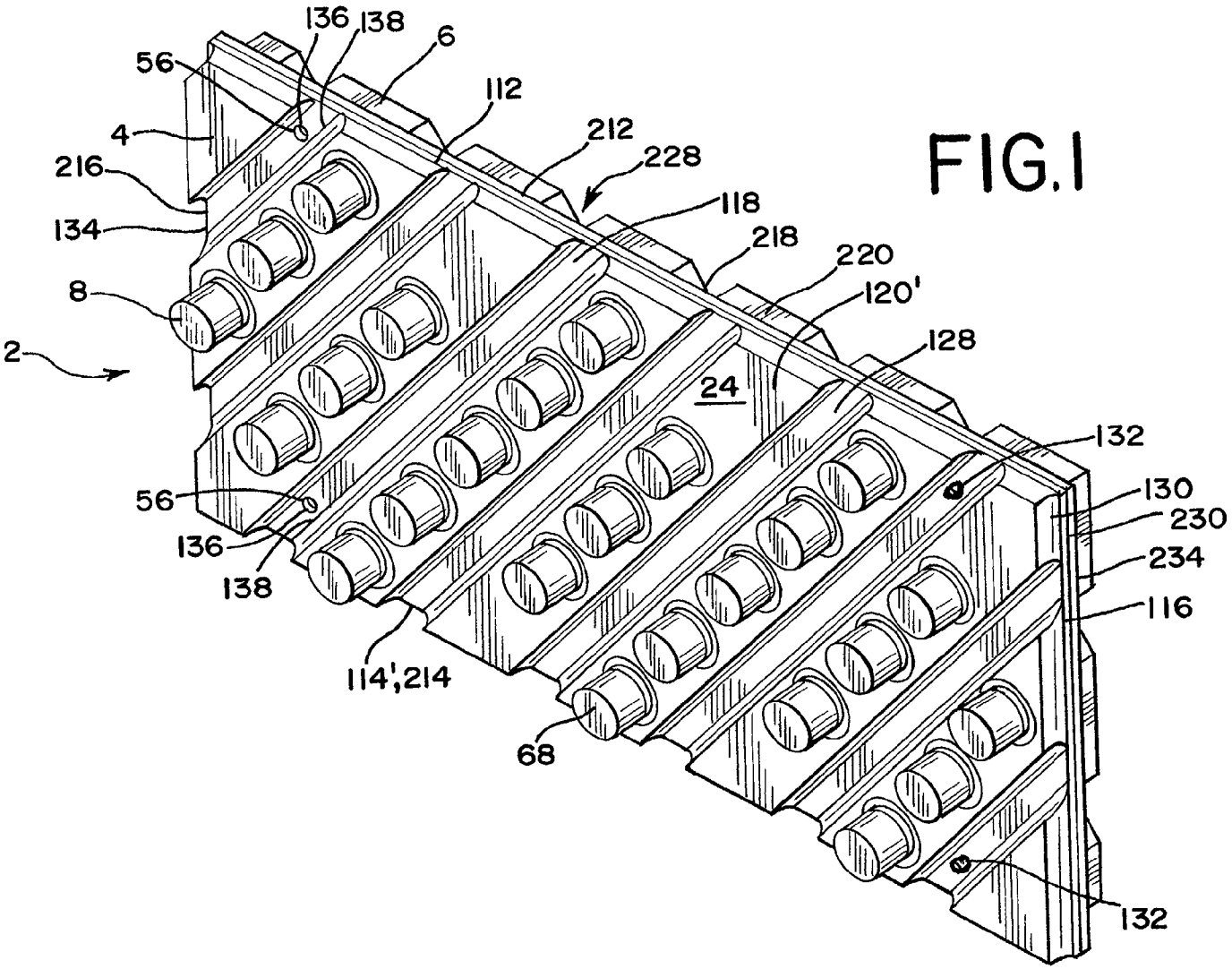
FIG. 1 is a perspective view of a message sign assembly.
Figure 2:
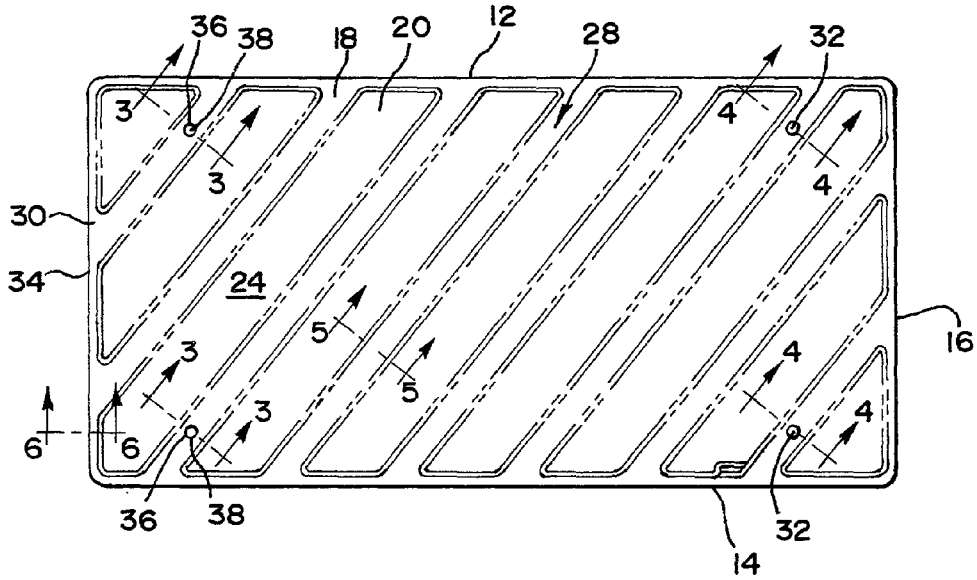
FIG. 2 is a front plan view of a panel blank.
Figure 15:
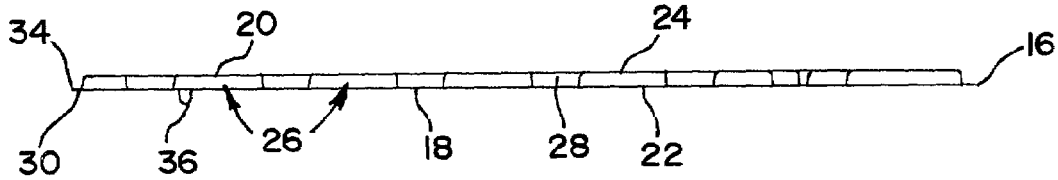
FIG. 15 is a bottom view of the panel blank shown in FIG. 2.

Referring to FIG. 1, a message sign 2 is shown as including first and second panels 4, 6. A plurality of display devices 8, shown as lamps, are secured through one or both of the panels. The term "plurality" as used herein means two or more. Preferably, the panels 4, 6 are connected one to the other without an internal frame disposed therebetween. Preferably, each panel 4, 6 is made from an identical panel blank 10, shown in FIGS. 2 and 15. Preferably, the panels 4, 6 are made of a hard plastic, such as ABS or polyethylene, although it should be understood that they can be made of other materials such as fiberglass, epoxies, and various metals, including aluminum.

Referring to FIGS. 1–8 and 15, each panel blank 10 and panel 4, 6 has a top 12, 112, 212, a bottom 14, 114, 214 and opposite side edges 16, 116, 216, 34, 134, 234, respectively, and preferably includes a base web 18, 118, 218 and a plurality of ribs 20, 120, 220 extending outwardly therefrom. In one preferred embodiment, shown in FIGS. 2, 7 and 8, nine ribs are formed in the panel blank 10, and corresponding panels 4, 6. The plurality of ribs 20, 120, 220 are preferably spaced apart in parallel relationship. Preferably, the ribs 120, 220 extend diagonally across the panel 4, 6, meaning they do not extend substantially horizontal or vertical.

In the preferred embodiment of FIGS. 1, 2, 7, 8 and 13, wherein the panel 4, 6 forms a quadrilateral figure, the ribs extend from one angle thereof to the opposite angle thereof, and in the preferred rectangular embodiment, are not parallel to the top 112, 212, bottom 114, 214 or sides 116, 216 of the panel 4, 6. Of course, it should be understood that the ribs 120, 220 may be oriented in the substantially vertical and horizontal directions, wherein they run longitudinally and laterally along the panel 4, 6, respectively. Preferably, the panels 4, 6 are rectangular, which includes square shapes, although they can be made in any shape, including without limitation triangles, circles, and non-symmetrical shapes. For example, in various preferred embodiments, the panels are rectangular and sized approximately 48 inches×96 inches, 24 inches×48 inches, 36 inches×72 inches or 30 inches×60 inches.

Each panel and blank preferably has an inner, or inside surface 22, 122, 222 and an outer or outside surface 24, 124, 224. As used herein, the terms "outer," "outside," "outward," "outwardly," "exterior," and variations thereof, means directed towards the intended user, whether directly exposed thereto or not. As used herein, the terms "inner," "inside," "inward," "inwardly," "interior," and variations thereof means directed away from the intended user.

Each of the plurality of ribs 20, 120, 220 forms an interior channel 26, 126, 226 while adjacent ribs form an exterior channel 28, 128, 228 therebetween in combination with the base web 18, 118, 218. Preferably, the ribs 20, 120, 220 have a width of about 8.50 inches, with the exterior channel separating the ribs preferably having a width of about 3.50 inches. Of course, other widths of greater or lesser dimension can be provided depending on the spatial requirements of the display device and/or the overall strength requirements for the panels. Preferably the side walls of the ribs defining the interior and exterior channels are angled or tapered. In addition, inner and outer radii are preferably formed at the corners of the various ribs and channels. Preferably, the base web 18, 118, 218 includes a lip portion 30, 130, 230 formed around an outer periphery of the panel blank 10 and panels 4, 6.

Figure 3:
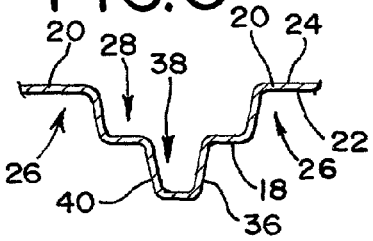
FIG. 3 is a section cut of the panel blank taken along line 3—3 of FIG. 2.
Figure 4:
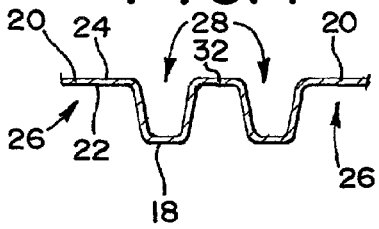
FIG. 4 is a section cut of the panel blank taken along line 4—4 of FIG. 2.
Figure 5:
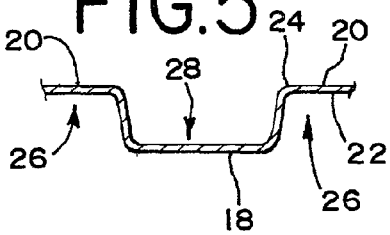
FIG. 5 is a section cut of the panel blank taken along line 5—5 of FIG. 2.
Figure 6:
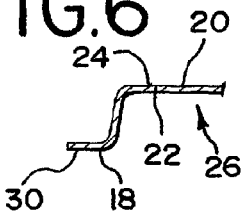
FIG. 6 is a section cut of the panel blank taken along line 6—6 of FIG. 2.

Referring to FIGS. 3 and 4, a pair of female recesses or sockets 32 are formed in and extend outwardly from the base web 18 in a pair of exterior channels 28 proximate one side 16 of the panel blank. The sockets 32, 132, 232 open inwardly from the panel blank 10 and panels 4, 6. Preferably, the sockets 32, 132, 232 are horizontally aligned and vertically spaced. On the opposite side of the panel, a pair of male protuberances 36, 136, 236, or male locator members, are formed in and extend inwardly from the base web 18, 118, 218 in a pair of exterior channels. Each locator member 36, 136, 236 also has a socket 38, 138, 328 or recess formed therein which opens outwardly from the panel blank 10 and panels 4, 6. Preferably, the male members 36, 136, 236 are horizontally aligned and vertically spaced. Preferably, the male members 36, 136, 236 are vertically spaced the same distance as the female sockets 32, 132, 232 and have an inner surface 40 shaped to be received in the female socket 32, 132, 232. Preferably, the female sockets 132, 232 and male members 136, 236 are spaced from a respective side 116, 216, 134, 234 of the panel 4, 6 an equal amount, such that when one of the panels is rotated or flipped over, the male members 136, 236 are received in the female sockets 132, 232 with the sides 116, 216, 134, 234 of the respective panels 4, 6 being aligned and substantially flush.

Each of the first and second panels 4, 6 can be uniquely configured to independently accommodate a display device 8. The term "display device," as used herein, broadly means any device capable of communicating instructional indicia, preferably visual, and includes without limitation, one or more lamps or lights, printed or painted text, variable message electronic boards or screens, and other known devices. For example, the display device can be configured as one or more lamps, which can be selectively lit to provide instructional indicia, such as directional information to drivers or workers on the roadways. In one preferred embodiment, the lamps are P46 12v 2.4W LED lamps made by National Signal, a Quixote Company, having a place of business at 14657 Industry Circle, La Mirada, Calif. 90638. Other suitable lamps include PAR 36 lamps and 4412a lamps, such as those available from General Electric, and other halogen glass lamps. The display device, for example the lamps, can be powered by a DC or AC power source, including batteries or solar panels, depending on the particular used. In one embodiment, the power source is located in an interior space formed between the first and second panels 4, 6. Preferably, the power source is located external to the first and second panels. The display device can display a permanent, set message, or can provide variable messages that are controlled by an operator, or by way of a controller or computer, which can be coupled to the display device.

Figure 7:
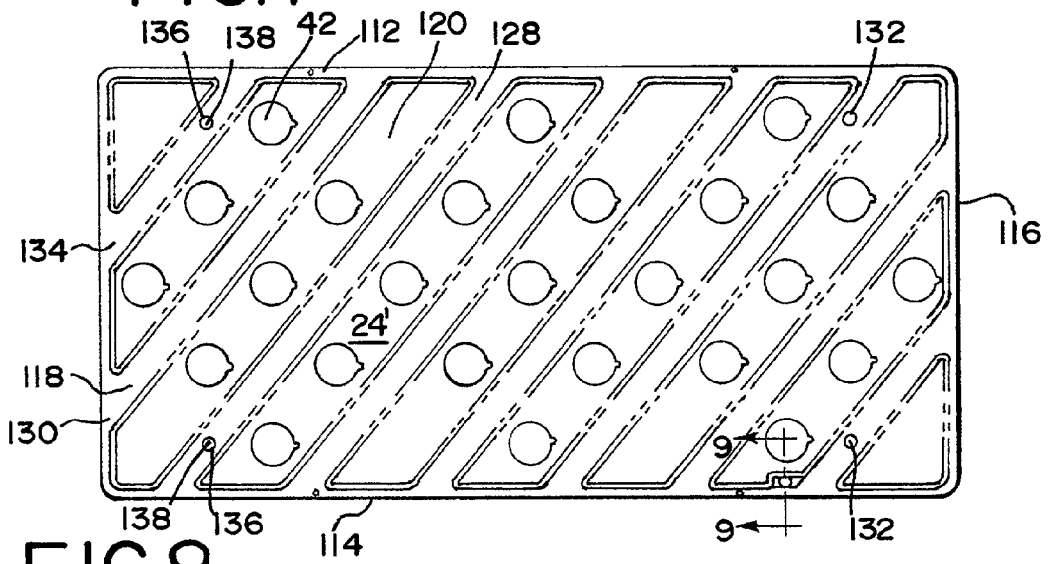
FIG. 7 is front plan view of a first panel.

In one preferred embodiment, shown in FIG. 7, the first panel 4 is configured with a plurality of openings 42 formed in a plurality of the ribs 120. Preferably, a plurality of openings 42 are formed in at least one of the ribs. For example, in one preferred embodiment, shown in FIG. 7, twenty-five openings 42 are formed in seven ribs 120. In other preferred embodiments between 15 and 20 openings are formed in the panel. In one preferred embodiment, the openings 42 are arranged in three horizontally spaced diamond patterns, such that lamps 8 mounted through the openings 42 can be selectively lit to display patterns that appear to be arrows pointing left, right, left and right, or moving from left to right and vice versa. In this way, the selectively lit lamps provide directional instructions to drivers on an adjacent roadway. Of course, it should be understood that more or less openings and lamps than those disclosed herein can be provided to allow for the display of other indicia, including text messages.

Figure 12:
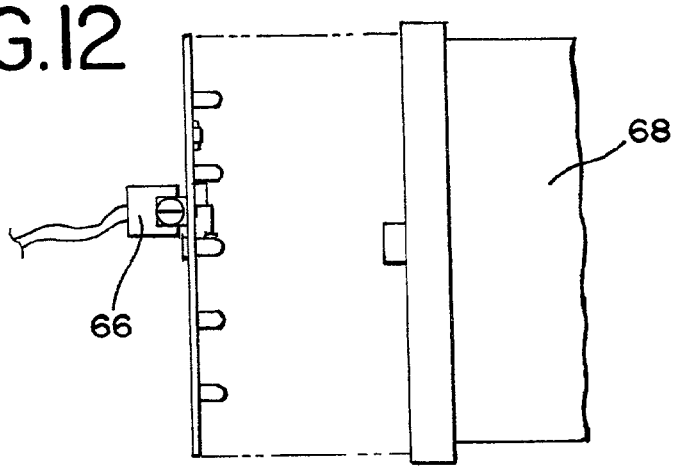
FIG. 12 is a side view of a lamp.

Preferably, the lamps 8 are mounted to the panel 4, 6 through the opening 42, with a portion of the lamp, preferably the backside which is preferably configured with various electrical contacts 66, being accessible from the interior channel 126, 226, and preferably with a portion of the lamp, including the contacts, disposed in one of the channels 126, 226. In one preferred embodiment, shown in FIG. 12, the lamps 8 include a plastic hood 68 that secures the lamp to the panel, preferably with a plurality of screws. In one preferred embodiment, slots are configured with an enlarged portion that allows the lamp to be removed without removing the screws. Preferably, the openings 42 are spaced along each rib 120 a distance equal to the spacing of the ribs 20, 120, 220 along a centerline thereof, such that the openings 42 will be aligned with interior channels 226 of the ribs 220 of the second panel 6, as explained in greater detail below.

Figure 8:
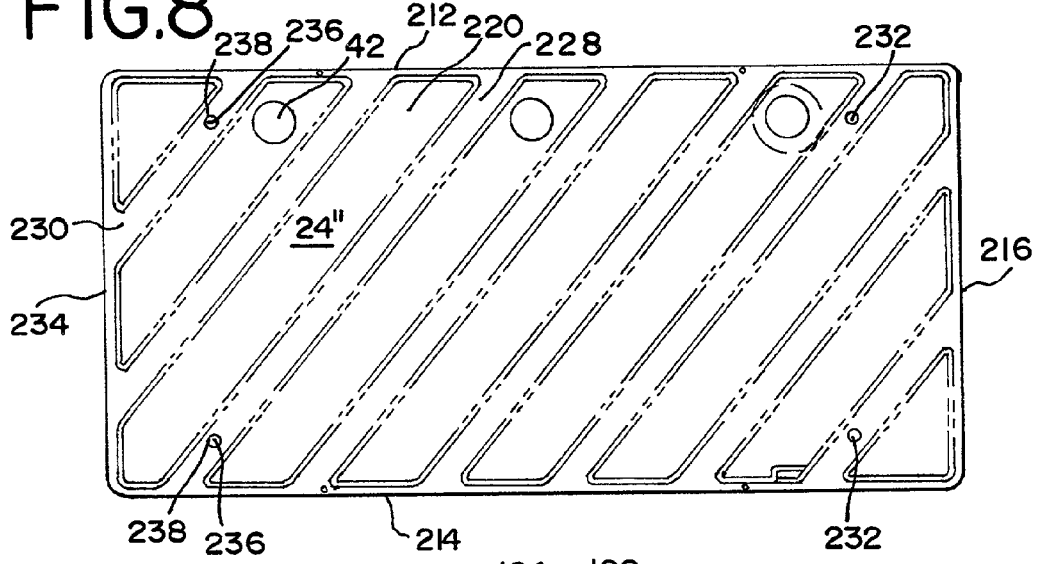
FIG. 8 is a front plan view of a second panel.

In one preferred embodiment, shown in FIG. 8, the second panel 6 is configured with a plurality of openings 42 formed in a plurality of the ribs 220. In one preferred embodiment, the panel 6 is configured with three openings positioned in every other rib adjacent the top 212 of the panel 6. Again, the openings 42 are positioned in the ribs 220 so as to be aligned with the interior channel 126 of the ribs 120 of the first panel 4.

Figure 10:
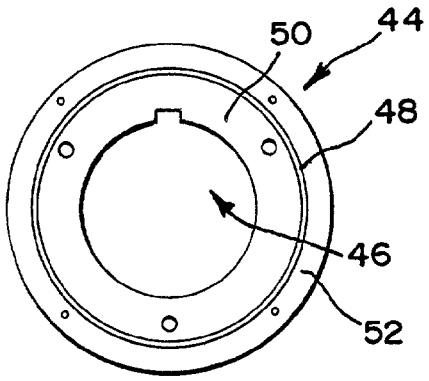
FIG. 10 is a plan view of a mounting bracket.
Figure 11:
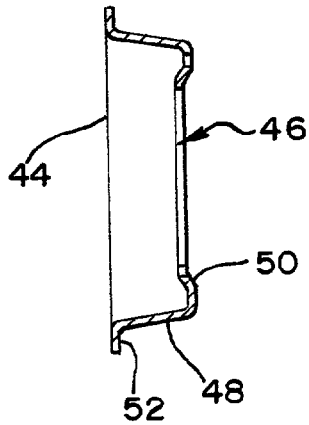
FIG. 11 is a section cut of the mounting bracket taken along line 11—11 of FIG. 10.

Referring to FIGS. 10–11, in one preferred embodiment, a mounting bracket 44 is preferably secured to the exterior surface 224 of the second panel 6 over the openings 42. The mounting bracket 44 is provided with an opening 46 shaped to receive a lamp, which is mounted to the mounting bracket. The mounting bracket 44 has an annular wall 48 that spaces a mounting plate 50 away from an annular flange 52 mounted to the rib 220 panel 6. In this way, the lamp, which is mounted to the mounting plate 50, is held away from the outer surface 224 of the ribs 220 of the second panel 6, and from the inner surface 122 of the opposite first panel 4, such that electrical contacts on the back of the lamp installed on the second panel 6 do not interfere with, or inadvertently contact, the electrical contacts on the lamps 8 installed on the first panel 4. Of course, it should be understood that the mounting bracket can be omitted, especially where the lamps are configured such that there is sufficient space therebetween for the electrical contacts.

In one preferred embodiment, wherein the message sign 2 is used adjacent a roadway, the first panel 4 faces the oncoming traffic, such that the display device 8 located thereon provides instructional indicia to drivers using the roadway. In the preferred embodiment, the display device 8 on the second panel 6, faces away from the traffic, and can provide indicia about whether the sign is activated, the condition of the power source, the nature of the message being displayed on the first panel, or other system parameters. Of course, it should be understood that the message sign can also be used to provide instructional indicia away from a roadway. For example, the sign can display the name of an establishment, the score of a sports contest, or directional information inside a building. In one exemplary embodiment, the display device is configured as a separate panel or board with message or indicia disposed or displayed thereon. The indicia can include various lights, electronic message devices, or painted and/or printed text. The display panel or board is secured to one or both of the message sign panels.

Referring to FIGS. 1–9, 13 and 14, the sign is preferably assembled by using a pair of identical panel blanks 10. Preferably, the blanks 10 are made by vacuum forming, although they can also be formed by blow molding, rotational molding or injection molding, and other known methods of molding plastic. In various alternative embodiments, for example, wherein the panels are made of metal, the panels can be formed by stamping and other know metal forming techniques. Depending on the particular display configuration, a plurality of openings 42 are formed, for example and without limitation by drilling or cutting, in the blank 10 to complete the first and second panels 4, 6. Of course, it should be understood that the openings 42 can be formed during the molding process, and also that the panels are not required to be made from identical blanks. However, the use of a single panel blank reduces inventory and manufacturing costs, including the cost of molds and the like. For example, it should be understood that alternatively the message sign can be integrally formed with the first and second panels formed as a one-piece unit during the molding or forming process. Alternatively, if the panels are made of metal, they can be formed by a pressing or forming process.

In a preferred embodiment, one or both of the panels 4, 6 are rotated such that the panels 4, 6 are arranged in a back-to-back relationship, with their inner surfaces 122, 222 facing each other. In one preferred embodiment, the panels 4, 6 are oriented such that the tops 112, 212 and the bottoms 114, 214 of the panels 4, 6 are aligned and flush, with the opposite sides 116, 216, 134, 234 of the panels 4, 6 being aligned as shown in FIG. 1. In an alternative preferred embodiment, the panels 4, 6 are oriented with the top edge 112, 212 of one panel aligned with the bottom edge 114, 214 of the other panel, and vice versa, such that the corresponding sides 116, 216, 134, 234 of the panels are aligned. In such an embodiment, the location of the male and female members may need to be relocated to mate with each other.

In the preferred embodiment, shown in FIG. 1, wherein the top and bottom edges 112, 212, 114, 214 of each panel are aligned, the male members 136, 236 are inserted into the female sockets 132, 232 and the inner surface 122, 222 of the base webs 118, 218 are abutted. A fastener 56, such as a rivet, screw or bolt, is secured through the panels 4, 6 at each of the four locations of mating male and female elements 136, 236, 132, 232. It should be understood that other fasteners can be secured at other locations without mating male and female members, for example along the abutting lip portions or in the channels 128, 228, or at other locations where the base webs abut between the ribs, and that adhesives and other bonding agents can also be used, alone and/or in combination with mechanical fasteners, to connect the panels. In one preferred embodiment, the first and second panels are firmly secured to each other around the entire perimeter and all interior crossing/abutting locations. In one preferred embodiment, a double-sided tape is used, e.g., the double-sided acrylic foam VHB (very high bond) tape #5952 available from Minnesota Mining and Manufacturing Co. In other preferred embodiments, the panels can be welded, for example by ultrasonic bonding. In the preferred embodiment, the male and female members 136, 236, 132, 232 quickly and easily locate the first and second panels relative to each other such that the panels can be connected. This arrangement avoids the need for expensive jigs, and/or the inaccuracies associated with alignment by hand or eye. In addition, a gasket or seal, e.g., a room temperature vulcanizing silicone, can be provided between the first and second panels, for example along peripheral lip portion. In the preferred embodiment, wherein the panels are bonded one to the other, the bonding provides a seal without the need for an additional gasket.

Figure 13:
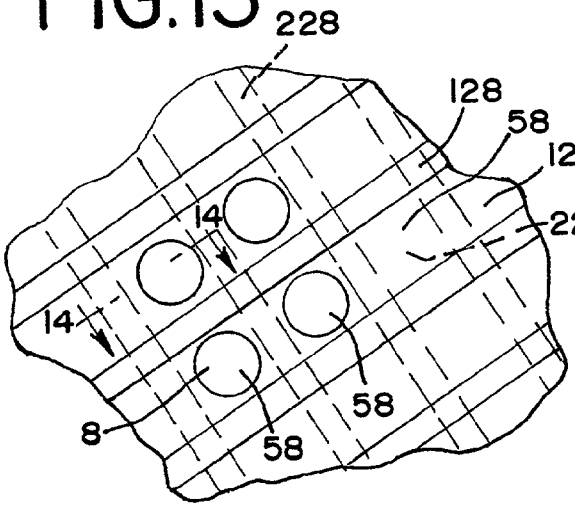
FIG. 13 is a schematic view of the first and second panel latticework.
Figure 14:
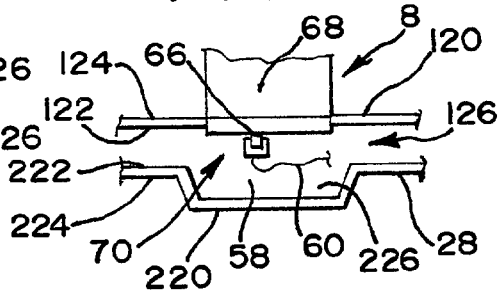
FIG. 14 is a section cut of the first and second panel taken along line 14—14 of FIG. 13.

When the panels 4, 6 are connected, the ribs 120 of the first panel 4, and the interior channels 126 formed thereby, cross the ribs 220 of the second panel 6, and the interior channels 226 formed thereby. The term "cross" as used herein means the elements intersect when superimposed in a single plane, and includes elements formed in different planes. As best shown in FIGS. 13 and 14, the crossing of intersecting channels 126, 226 form a lattice work with a plurality of junctures 58, which define pockets 70 of maximum depth substantially equal to the depth of the two channels. Preferably, the openings 42, and lamps 8 disposed therein, are aligned with or over the junctures 58, such that the lamp 8 can extend into the interior of the message sign between the panels 4, 6 without interference. It should be understood that the openings 42 can be formed in the first and second panels 4, 6 either before or after they are connected. The "waffle-board" structure, created by the intersecting and crossing ribs 120, 220 and channels 126, 226, 128, 228 provides exceptional structural rigidity, which avoids the need for an internal frame structure and the attendant costs associated therewith.

Figure 16:
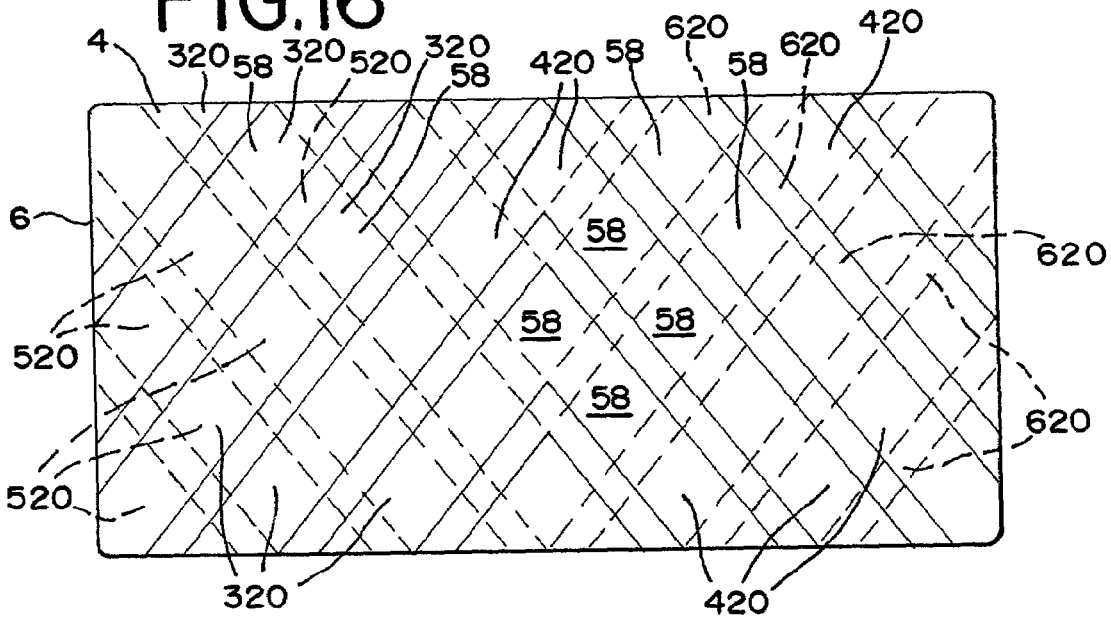
FIG. 16 is a schematic view of an alternative embodiment of a first and second panel latticework.

In one alternative embodiment, shown in FIG. 16, the ribs 320 on one side of the first panel 4 are preferably substantially parallel and run diagonally in a first direction, while the ribs 420 on the other side of the panel are preferably substantially parallel and run diagonally in a second direction non-parallel to the first direction. Preferably, at least some of the ribs 320, 420 on each side intersect, and thereby form a V-shaped configuration. The second panel 6 is formed with the same rib 520, 620 configuration, but is rotated such that the ribs of the first panel cross the ribs of the second panel. The resulting lattice work yields a plurality of junctures 58.

It also should be understood that the ribs are not necessarily linear. For example, the ribs can be curvilinear, or form circles or other non-linear patterns. In one exemplary embodiment, a plurality of circular or arcuate ribs can be formed in an interlocking configuration on each panel, with the ribs, and the channels formed thereby, forming a plurality of junctures between the first and second panels when the panels are secured one to the other.

Figure 9:
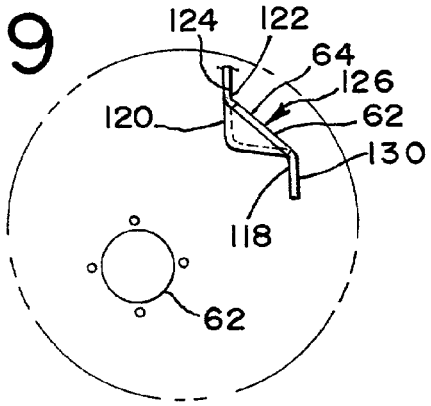
FIG. 9 is a section cut of the first panel taken along line 9—9 of FIG. 7.

Preferably, an electrical harness 60, or electrical connector or conduit, is disposed in the channel lattice or gridwork formed between the two panels 4, 6, and is routed and connected to the lamps 8 secured in the first and second panels, preferably to the contacts 66. Referring to FIGS. 7 and 9, an opening 62 is formed in a slanted surface 64 adjacent the bottom 14' of the first panel 4. The electrical harness 60 can be connected through the opening to an external power source or controller. In some embodiments, the sign is rotated during deployment from a substantially horizontal orientation to a substantially vertical orientation. In this way, the sign can be easily transported in the horizontal orientation. The slanted surface allows a cable connected to the sign and electrical harness to flex only + or −45 degrees, rather than having to bend from 0 degrees to 90 degrees, or from 90 degrees to 0 degrees, as the sign is rotated during deployment. As set forth above, mounting brackets 44 can be provided on the first and/or second panel 4, 6 to space one or more lamps 8 away from the opposite panel, so as to provide additional space for the lamps, electrical contacts thereon, and electrical harness.

If one of the panels 4, 6 is damaged, the damaged panel can be easily replaced simply by removing the fasteners 56 and replacing the damaged panel. Likewise, if both panels 4, 6 are damaged, the sign can be easily disassembled to recover the electrical harness and any other components, such as a controller, located in the interior space between the panels. In addition, in the preferred embodiment, the plastic material of the panel provides a resilient material that cushions the impact if the message sign is struck by an errant automobile or person, or if the sign is dislodged from its support structure.

In a preferred embodiment, the sign is supported by an exterior support frame, which can be located on a portable trailer or maintenance/construction vehicles, or can be adapted to sit on the ground. Preferably, the frame is secured to the panels along a top and bottom edge thereof, preferably with mechanical fasteners, although the frame can also be secured to the side edges. Of course, it should be understood that the sign can also be supported or suspended from above, or from a side thereof.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A message sign comprising:

a first panel comprising a first plurality of ribs each defining an interior channel;

a second panel comprising a second plurality of ribs each defining an interior channel, wherein each of said first and second panels comprise a base web, wherein said base webs of said first and second panels are connected, and wherein said first and second plurality of ribs extend outwardly from said base webs of said first and second panels respectively in opposite directions, said first and second panels oriented such that at least some of said channels of said first panel cross at least some of said channels of said second panel and form a plurality of junctures of crossing channels of said first and second panels, wherein said crossing channels of said first and second panels open into each other at at least one of said junctures of crossing channels so as to form a pocket between said crossing channels at said at least one juncture of crossing channels; and at least one lamp secured through an opening in at least one of said first plurality of ribs at said at least one juncture of crossing channels forming said pocket.

2. The message sign of claim 1 wherein said at least one opening comprises a plurality of said openings formed in at least some of said first plurality of ribs, and wherein said at least one lamp comprises a plurality of lamps secured through said plurality of said openings at a plurality of said junctures of crossing channels.

3. The message sign of claim 1 further comprising an electrical harness disposed between said first and second panels and connected to said at least one lamp.

4. The message sign of claim 1 further comprising at least a second lamp secured through an opening in at least one of said second plurality of ribs of said second panel at one of said junctures of crossing channels.

5. The message sign of claim 1 wherein said first and second panels are made of plastic, and wherein said base web and said ribs of each of said first and second panels are integrally molded as a one-piece unit.

6. The message sign of claim 5 wherein said first and second panels are secured to each other with a plurality of fasteners.

7. The message sign of claim 5 wherein said first and second panels are bonded to each other.

8. The message sign of claim 5 wherein each of said first and second panels is rectangular and has a top, a bottom and a pair of opposite sides, and wherein said ribs of said first and second panels extend diagonally across said first and second panels respectively.

9. The message sign of claim 1 wherein said first plurality of ribs are spaced apart in substantially parallel relationship, wherein said second plurality of ribs are spaced apart in substantially parallel relationship, said first and second panels oriented such that at least some of said first and second pluralities of ribs of said first and second panels are oriented in a substantially non-parallel relationship.

10. A message sign comprising:

a first panel comprising a first plurality of ribs each defining an interior channel and a first base web connecting said first plurality of ribs;

a second panel comprising a second plurality of ribs each defining an interior channel and a second base web connecting said second plurality of ribs, wherein said second panel is connected to said first panel, and wherein said first and second panels are oriented relative to each other such that at least some of said first plurality of channels of said first panel cross at least some of said second plurality of channels of said second panel and form a plurality of junctures of crossing channels of said first and second panels, wherein a portion of said first and second channels open toward each other at said plurality of juncture of crossing channels, wherein a portion of said channels of said first panel open toward said second base web of said second panel and wherein a portion of said channels of said second panel open toward said first base web of said first panel; and a display device connected to at least one of said ribs of said first panel, wherein said display device comprises a plurality of lamps secured through a plurality of first openings formed in at least some of said first plurality of ribs of said first panel over at least some of said plurality of said junctures of crossing channels.

11. The message sign of claim 10 wherein said first plurality of ribs are spaced apart in substantially parallel relationship, wherein said second plurality of ribs are spaced apart in substantially parallel relationship, and wherein said first plurality of ribs of said first panel are oriented in a non-parallel relationship with said second plurality of ribs of said second panel.

12. The message sign of claim 10 wherein said first plurality of ribs extend outwardly from said first base web, wherein said second plurality of ribs extends outwardly from said second base web, and wherein said first and second base webs are connected, with said first plurality of ribs of said first panel extending away from said second plurality of ribs of said second panel.

13. The message sign of claim 10 further comprising at least a second lamp secured through a second opening in at least one of said second plurality of ribs of said second panel, wherein said second lamp has a portion disposed in said channel of said rib of said second panel at one of said junctures of crossing channels.

14. The message sign of claim 10 wherein said first and second panels are made of plastic, and wherein said base web and said ribs of each of said first and second panels are integrally molded as a one-piece unit.

15. The message sign of claim 10 wherein said first and second panels are secured to each other with a plurality of fasteners.

16. The message sign of claim 10 wherein said first and second panels are bonded to each other.

17. The message sign of claim 10 further comprising an electrical harness disposed between said first and second panels and connected to said display device.

18. The message sign of claim 10 wherein said first and second panels have a substantially identical shape.

19. The message sign of claim 10 wherein each of said first and second panels is rectangular and has a top, a bottom and a pair of opposite sides, and wherein said ribs of said first and second panels extend diagonally across said first and second panels respectively.

20. The message sign of claim 10 wherein said display device comprises a first display device and further comprising a second display device connected to at least one of said second plurality of ribs of said second panel.

* * * * *